United States Patent [19]

Puschnus et al.

[11] Patent Number: 4,737,044

[45] Date of Patent: Apr. 12, 1988

[54] METHOD OF PRINTING CHARACTERS IN TYPEWRITERS OR SIMILAR OFFICE MACHINES

[75] Inventors: Werner Puschnus, Nuremberg; Rainer Hauser, Ruckersdorf, both of Fed. Rep. of Germany

[73] Assignee: TA Triumph-Adler Aktiengesellschaft für Büro-Informationstechnik, Nuremberg, Fed. Rep. of Germany

[21] Appl. No.: 8,862

[22] Filed: Jan. 30, 1987

[30] Foreign Application Priority Data

Jul. 31, 1986 [DE] Fed. Rep. of Germany ..... 3527432

[51] Int. Cl.[4] ..... B41J 9/26

[52] U.S. Cl. ..... 400/157.3; 400/144.2

[58] Field of Search ..... 400/61, 139, 144.2, 400/144.3, 157.3, 166; 364/200, 900

[56] References Cited

U.S. PATENT DOCUMENTS

| | | | |
|---|---|---|---|
| 3,858,509 | 1/1975 | Grundherr | 400/144.2 |
| 4,037,208 | 7/1977 | Osterlund et al. | 400/157.3 |
| 4,118,129 | 10/1978 | Grundherr | 400/61 X |
| 4,429,306 | 1/1984 | Macauley et al. | 340/790 |
| 4,627,751 | 12/1986 | Nakajima | 400/144.2 |
| 4,644,477 | 2/1987 | Kojima | 400/144.2 X |
| 4,653,945 | 3/1987 | Sato et al. | 400/144.2 |
| 4,687,356 | 8/1987 | Matsui et al. | 400/157.3 X |

*Primary Examiner*—Edgar S. Burr
*Assistant Examiner*—Joseph McCarthy
*Attorney, Agent, or Firm*—Browdy & Neimark

[57] ABSTRACT

A code generated by a keyboard or external data source is first converted to an ordinal number code which is processed by first and second algorithms to generate a typing force index and a character type location identifier respectively. The typing force index is used as a variable in an equation whose solution provides typing force information, and the character location identifier is used to calculate character type location information. The information is utilized to position a selected character on a print wheel and to print the selected character with a force depending on the area of the character.

5 Claims, 2 Drawing Sheets

| TYPE NO | POSSIBLE ORDINAL NUMBER | LOCATOR | DESIRED TYPING FORCE | RESULTING ORDINAL NO. FOR STORAGE |
|---|---|---|---|---|
| 1 | 0 100 200 300 400 500 600 | I | 5 | 200 |
| 2 | 1 101 201 301 401 501 601 | II | 7 | 601 |
| 3 | 2 102 202 302 402 502 602 | III | 2 | 302 |
| 4 | 3 103 203 303 403 503 603 | IV | 6 | 103 |
| 5 | 4 104 204 304 404 504 604 | V | 1 | 504 |
| 6 | 5 105 205 305 405 505 605 | VI | 4 | 605 |
| 7 | 6 106 206 306 406 506 606 | VII | 3 | 506 |
| 8 | 7 107 207 307 407 507 607 | I | 5 | 207 |
| 9 | 8 108 208 308 408 508 608 | II | 4 | 108 |
| 10 | 9 109 209 309 409 509 609 | III | 7 | 209 |
| ⋮ | | | | |
| 100 | 99 199 299 399 499 599 699 | | | |

C

| TYPE NO | POSSIBLE ORDINAL NUMBER | DESIRED TYPING FORCE | RESULTING ORDINAL NO. FOR STORAGE |
|---|---|---|---|
| 1 | 0 100 200 300 400 500 600 | 5 | 400 |
| 2 | 1 101 201 301 401 501 601 | 7 | 601 |
| 3 | 2 102 202 302 402 502 602 | 2 | 102 |
| 4 | 3 103 203 303 403 503 603 | 6 | 503 |
| 5 | 4 104 204 304 404 504 604 | 1 | 4 |
| 6 | 5 105 205 305 405 505 605 | 4 | 305 |
| 7 | 6 106 206 306 406 506 606 | 3 | 206 |
| 8 | 7 107 207 307 407 507 607 | 5 | 407 |
| 9 | 8 108 208 308 408 508 608 | 7 | 608 |
| ⋮ | | | |
| 100 | 99 199 299 399 499 599 699 | | |
C'
FIG. 2
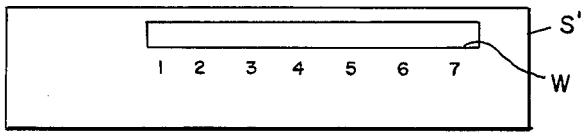
FIG. 2A
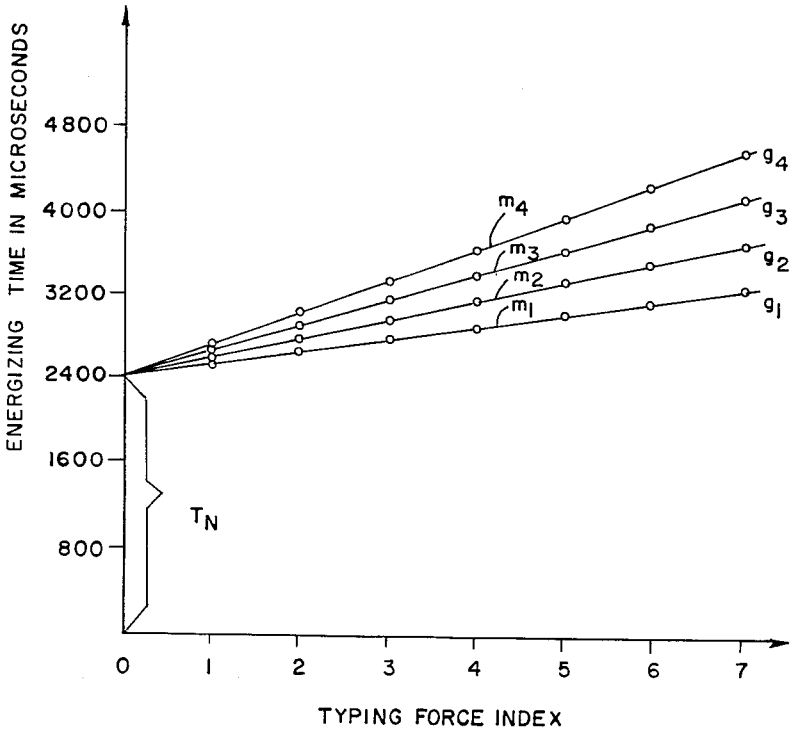
FIG. 3

METHOD OF PRINTING CHARACTERS IN TYPEWRITERS OR SIMILAR OFFICE MACHINES

BACKGROUND OF THE INVENTION

1. Field of the Invention

This invention relates to a method for printing out characters represented by input codes; more particularly it relates to a method for deriving from input codes information for positioning a print wheel to present a character for printing and information for controlling the force of print impact.

2. Description of Related Art

Machines of the above-mentioned kind often contain a so-called single element type carrier, such as a spherical head or a typewheel disposed opposite a platen. Located between the single element type carrier and platen are usually a ribbon and a record carrier. These machines produce type impressions of uniform print density by impacting the character to be reproduced and positioned at a printing position with a selected force or intensity level depending on the size of the character.

In machines as described above a control system is necessary to obtain from a code generated by actuating a key or provided by an external apparatus, such as a data processing system, information on the location on the single element type carrier of the type character to be printed, as well as information on the force with which the character to be printed must be accelerated towards the record carrier. Heretofore this has been accomplished in that the said code was converted into character positioning information and impact intensity information, using at least two tables stored in a memory. An example of such a control concept can be found in DE-PS No. 25 29 310 corresponding to U.S. Pat. No. 4,118,129.

In U.S. Pat. No. 4,118,129, the positioning and harmer intensity information were stored in tables comprising upper and lower halves of a ROM and the information was obtained by sequentially addressing first the upper half, and then after the type wheel was positioned, the lower half.

While this procedure is very simple, it has a serious disadvantage. Considering that in today's typewriters or printers different type carriers with different type faces of uniform and/or proportional pitch are used, it becomes clear that different tables are required to determine the hammer intensity information, as a function of the respective kinds of type face. The number of tables required increases further if one considers that, depending on the number of copies to be made, manifold settings establishing different basic typing forces for one and the same set of characters must be realised.

SUMMARY OF THE INVENTION

In accordance with the invention the amount of memory necessary to accommodate a plurality of type fonts is significantly reduced by employing a ROM which converts input codes into ordinal numbers, one for each character. If, on different typewheels, the same characters are on the same type no. spokes, only one ordinal number table in memory is necessary. These ordinal numbers do not themselves represent either character location or hammer intensity information but they are selected by a programmer to contain information from which, according to programmed instructions, a type spoke location code can be derived for use in positioning a type wheel and from which a typing force index code can be derived which represents the variable for use in one of a plurality of linear equations representing different manifold settings and whose solution is a hammer intensity code for use in energizing a print hammer to print the character in a selected font.

An object of the invention is to provide a method of printing characters with typewriters or similar office machines which produces uniform print density for a variety of type fonts with a minimum of memory.

Another object of the invention is in the provision of a method which permits the printing of characters with a minimum of memory storage capacity and several simple algorithms whose basic operation may be contained in memory normally provided in a typewriter to store programs.

Other objects, features and advantages of the present invention will become better known to those skilled in the area from a reading of the following detailed description when taken in conjunction with the accompanying drawing wherein like reference numerals designate like or corresponding elements throughout the several views thereof and wherein:

BRIEF DESCRIPTION OF THE DRAWING

FIGS. 2 and 2A are views similar to FIGS. 1 and 1A for another embodiment; and FIG. 3 is a plot of a family of curves defining linear equations for determining hammer intensity information from derived typing force index numbers.

DETAILED DESCRIPTION

Figures 1, 1A:
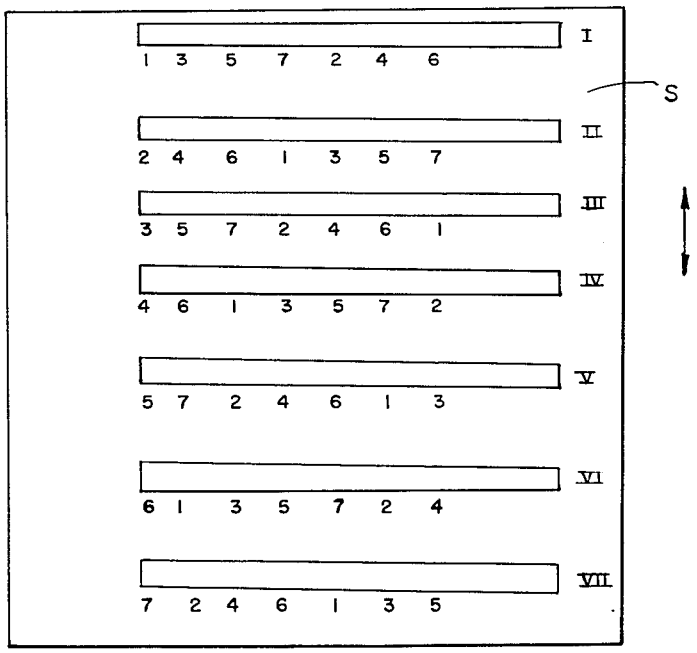
FIG. 1 is a number chart showing numbered type locations in a typewheel, and possible ordinal numbers which define the type location and an associated desired intensity.
FIG. 1A is a tool to be used by a programmer to read out the FIG. 1 chart to obtain an ordinal number to be stored in ROM according to the force with which it is desired to impact the character at a given type location.

In the description which follows references will be to conditions prevailing in type wheel or daisy wheel typewriters though the invention is applicable to other forms of printer where provision is made to print characters with impact forces related to character areas, and wherein character positioning information and hammer intensity necessary for printing are generated with the use of a programmed microprocessor.

As is generally known, a type carrier carriage is arranged opposite a platen in typewheel typewriters. The type carrier carriage is movable along the platen by means of a motor such as a stepper motor and supports, besides the typewheel and its associated drive motor, a ribbon and its associated ribbon transport mechanism, a correction tape and its associated correction tape transport mechanism, and a print hammer driven by an electromagnet. According to the state of the art, the above named units are controlled by a programmable control unit which usually contains at least one microprocessor with associated ROM and RAM memory and, if applicable, additional logic circuits and the driver circuits needed to drive the units. The characters are put in via a keyboard with which a switch matrix is usually coordinated which is interrogated cyclically by the programmable control unit to determine depressed keys.

In such typewheel typewriters, when the programmable control unit has found a depressed key corresponding to a character during at least one scan cycle, a code assigned to the key and generated by the control unit is converted by the programmable control unit into a type location identifier and an energizing information for the print hammer electromagnet. From the thus generated type location identifier of the last character printed the programmable control unit obtains character positioning information, according to which the typewheel drive motor, controlled by the programmable control unit, is energized to bring the desired character into printing position. When the character to be printed is in printing position, the control unit applies the obtained energizing information to the hammer electromagnet, so that with a ribbon in working position, the spoke on which the type to be printed is located is accelerated towards the ribbon or record carrier located between ribbon and platen, with the force defined by the energizing information.

The critical point in this control cycle is in the conversion of the code corresponding to the key into a type location identifier and energizing information for the print hammer electromagnet. This conversion is problematical because, on the one hand, the codes assigned to the keys are fixed and, on the other hand, the location of the character on the typewheel is given. While the procedure to be followed according to the state of the art concerning how to convert the codes through tables is simple, it requires relatively much memory space, as heretofore indicated.

In accordance with the invention a microprocessor is used (a) to convert the binary code of the character to be printed into an ordinal number with the help of a stored ordinal number memory table;

(b) to apply to the ordinal number a first algorithm leading to a typing force index;

(c) to apply to the ordinal number of a second algorithm leading to a type location identifier;

(d) to apply to the typing force index a computable function f(x) leading to hammer magnet energizing information according to which the print hammer must be energized to generate a correct print of the character to be printed;

(e) to compute from the type location identifier of the character to be printed and from the type location identifier of the character in typing position, which is stored in the memory, a positioning information;

(f) to position the character to be printed into typing position by executing the positioning information; and (g) to energize the print hammer electromagnet with the energizing information determined.

As is evident from step (a), the binary code corresponding to the character to be printed, e.g., the code generated by the actuation of a key, is converted into an ordinal number by means of a stored ordinal number table. The ordinal number, in the form of a binary code, must meet several conditions because, as is evident from steps (b) and (c), it is converted into a typing force index by a first algorithm and into a type location identifier by a second algorithm. It has been found that, for single element type carriers with N types, e.g. 100, each to be printed with one of M typing forces, e.g. 7, an unequivocal relationship between ordinal number and typing force index and type location identifier can be established regardless of the arrangement of the types on the single element type carrier, if the total number of ordinal numbers from which N ordinal numbers were selected corresponds to the smallest common multiple of N and M. An optimum is reached when the smallest common multiple of N and M equals the product of M and N. Which one of the various ordinal numbers is actually assigned to a type location depends upon the typing energy with which the type at a type location is to be printed. It is assumed in the following that $M=7$ and $N=100$, resulting in a total of 700 possible ordinal numbers, from which, for a 100 character typewheel, selection of 100 are to be made. This means that one of seven possible ordinal numbers is assigned to each type.

With reference to FIGS. 1 and 1A, the manner of determining the one of several possible ordinal numbers to be stored in accordance with a first embodiment of a method to be described infra, will be described. In FIG. 1 there is shown a Chart C depicting type numbers or locations and seven possible ordinal numbers. Outside of and to the right of the chart C is a list of typing forces desired or to be selected for each type number. Chart C also includes a repeating series of Roman numerals I–VII as shown.

With reference to FIG. 1A, a slider tool S with seven windows I–VII is provided. Printed below each window are seven typing force values, in a predetermined arrangement. The tool S is moved to align one of the windows I–VII thereon with the Roman numerals opposite the Type Number on the chart C for which an ordinal number is to be selected. Thus, to determine the ordinal number for Type No. 1 which is to have a desired typing force of 5, Roman window I of tool S is placed on the chart to overlie Roman numeral I opposite Type No. 1. Then the ordinal number appearing in window I above force 5, namely 200 can be read. The resulting ordinal numbers for the desired force levels for 10 types are shown in FIG. 1.

With reference to FIG. 2, the method for determining ordinal numbers to be stored in accordance with a second embodiment to be described infra, will be explained. In FIG. 2, like FIG. 1, there is shown on Chart C′ containing type numbers and possible ordinal numbers. Off the chart to the right are shown desired type forces and resulting ordinal numbers.

As shown in FIG. 2A, a tool S′ having a window W below which are indicated predetermined force values 1–7 is adapted to be placed over the chart C′ so that the window W exposes the ordinal numbers opposite a type number whose ordinal number is to be determined. Thus, if Type No. 1 is to be associated with a desired typing force of 5, a programmer would read out the ordinal number in the window above number 5 on the tool S′ to get ordinal number 400. Resulting ordinal numbers for type numbers 1–9 are shown in FIG. 2.

According to steps (b) and (c) of the methods of the invention, the microprocessor first applies to a stored ordinal number to which an input code has been converted, a first algorithm leading to a typing force index (step (b)), and then a second algorithm leading to a type location identifier (step (c)). Two embodiments of a method for steps (b) and (c) are given in the following.

In a first embodiment the microprocessor first applies to the ordinal number a mod M algorithm, i.e. it forms an integral quotient and remainder of the stored ordinal number and the number M (7) of possible typing forces. The integral quotient itself is neglected, the remainder represents the typing force index. This operation corresponds to step (b). To obtain the type location identifier, the microprocessor performs a mod N algorithm, i.e. it forms an integral quotient and remainder of the ordinal number and the number N (100) of type locations. Again the integral quotient is neglected, and the remainder represents the type location identifier. This operation corresponds to step (c).

In a second embodiment the microprocessor first forms an integral quotient and a remainder of the stored ordinal number and the number N (100) of type locations present. The integral quotient corresponds to the typing force index. This operation corresponds to step (b). The type location identifier is represented by the remainder of the mod N algorithm already executed in step (b). The determination of the remainder thus corresponds to step (c).

Further, the use of a typewheel with 100 types to be printed with one of seven different typing forces requires, if the smallest and greatest possible ordinal numbers are 0 and 699 as shown in FIGS. 1 and 2, a one must be added by the microprocessor to the results obtained from steps (b) and (c) of either embodiment as indicated in following Tables A and B.

Table A and B infra represent the results of mod M and mod N calculations applied to stored ordinal numbers selected for 10 specific type numbers, according to the above described first and second embodiments to secure Quotients and Remainders to which ones are added to provide Typing Force Index and Type Location Identifiers.

TABLE A

| Ordinal Number | Typing Force Index (mod M) Remainder + 1 | Type Location Identifier (mod N) Remainder + 1 |
|---|---|---|
| 200 | 5 | 1 |
| 601 | 7 | 2 |
| 302 | 2 | 3 |
| 103 | 6 | 4 |
| 504 | 1 | 5 |
| 605 | 4 | 6 |
| 506 | 3 | 7 |
| 207 | 5 | 8 |
| 108 | 4 | 9 |
| 209 | 7 | 10 |

Where mod M = $\frac{\text{Ordinal No.}}{7}$ and mod N = $\frac{\text{Ordinal No.}}{100}$

TABLE B

| Ordinal Number | Typing Force Index (mod N) Quotient + 1 | Type Location Identifier = (mod N) Remainder + 1 |
|---|---|---|
| 400 | 5 | 1 |
| 601 | 7 | 2 |
| 102 | 2 | 3 |
| 503 | 6 | 4 |
| 4 | 1 | 5 |
| 305 | 4 | 6 |
| 206 | 3 | 7 |
| 407 | 5 | 8 |
| 308 | 4 | 9 |
| 609 | 7 | 10 |

Where mod N = $\frac{\text{Ordinal No.}}{100}$

More specifically, Table A shows the ordinal numbers selected in FIG. 1 which, when applying the algorithms in the first embodiment, furnish the value for the Typing Force Index and Type Location Identifier, respectively.

With reference to Table B, there are shown the ordinal numbers for the first ten type character positions on a typewheel, as determined from FIG. 2 which when applying the algorithm according to the second embodiment, furnish Table B values for the Typing Force Index and Type Location Identifier, respectively.

To realize different typing forces, the print hammer drive electromagnet in typewheel typewriters must be energized so as to propel the types with a different force towards the ribbon or record carrier. To accomplish this, the microprocessor varies e.g. the energizing time of the electromagnet in accordance with energizing information, corresponding to the desired typing force. Starting from step (b) this means that the microprocessor must first convert the typing force index found there into an energizing information; in the example selected, the energizing information corresponds to an energizing time. To accomplish this, step (d), the typing force index is used as the variable x of a computable function f(x). With regard to this step (d) it was assumed that there must be computable functions by which the various energizing informations (energizing times) can be represented as a function of the typing force index. It was possible to find, by way of the energizing times realized in machines already manufactured, that they can be represented, with quite a good accuracy and various kinds of type faces and different basic typing forces, by linear functions, as a function of the typing force index. Such a cluster of straight lines is shown in FIG. 3. Therein, the numbers on the abscissa correspond to the respective typing force index while the typing time is plotted on the ordinate in microseconds. The straight lines marked $g_1$, $g_2$, $g_3$, $g_4$ each fix, for one kind of type face and one basic typing force, the energizing times (ordinate values) for the various typing forces 1 to 7 (abscissa values). Straight line curves $g_1$–$g_4$, for example, might represent respectively, a weak force for a uniform type font, a medium force for a uniform or a weak force for a proportioned font, a strong force for a uniform or a medium for a proportional type font, and a strong force for a proportional type font.

The situation shown in FIG. 3 can now be transformed so that, instead of the storing in memory all energizing times for different fonts and manifold settings, only the equation for their computation need be stored in memory. Assuming that the stored straight line equation is:

$$y_n = m_n \cdot x + t_n$$

with $y_n$ = typing time in microseconds for the straight line $g_n$ $m_n$ = slope of the straight line $g_n$ $t_n$ = initial value for the straight line $g_n$ x = typing force index it becomes clear that only the $m_n$ and $t_n$ values need to be stored instead of the seven different time values. If $t_n$ is the same for all straight lines, as shown in FIG. 3, only five values $t_n$, $m_1$, $m_2$, $m_3$, $m_4$ need be stored to be able to compute twenty-eight different energizing times for the four different manifold settings $g_1$–$g_4$. The computation itself requires little expenditure because the basic operations (multiplication, addition) are already contained in the programs of a typewriter of the kind mentioned at the outset.

Of course, the energizing information, corresponding to an energizing time in the example chosen, may also be a current, a voltage, the duty factor of a pulse sequence, etc. Which quantity or quantities are used as energizing information depends on both the typing system drive used and the choice of the function f(x) for the conversion of the typing force index into the energizing information.

Now that the type location identifier is available from step (c) and the energization information from step (d), the actual typing process can be executed. The microprocessor computes in step (e), from the type location identifier of the character to be printed, as found in step (c), and from the type location identifier of the character momentarily in typing position, which is stored in the memory, typewheel positioning information, which is used to drive, via an appropriate driver circuit, in step (f) the typewheel drive motor in such a manner that the type corresponding to the character to be printed gets into typing position. Here again, the kind of positioning information depends on the typewheel drive motor used. In another step (g), the microprocessor now applies the energizing information found in step (d) to the print hammer electromagnet, for a period of time corresponding to the energizing information, via a driver circuit, thereby causing the type to be printed to be propelled with a predetermined force towards the ribbon or record carrier.

The invention claimed is:

1. A method of printing characters with typewriters or similar office machines containing a summary type carrier each of whose N different types are to be printed by a hammer with a selected one of M different printing energies, the printing of a type being controlled, as a function of a binary code corresponding to the type, by a programmable control unit containing at least one microprocessor and memory, said method comprising the steps of (a) converting the binary code of the character to be printed into an ordinal number with the help of a stored table, (b) applying to the ordinal number a first algorithm to determine a typing force index, (c) applying to the ordinal number a second algorithm to determine a type location identifier, (d) utilizing said typing force index to determine a computable function f(x) to determine an energizing information according to which a hammer must be energized to print a character to be printed with a desired impact force, (e) utilizing said determined type location identifier and the type location identifier of the last printed type stored in memory, to compute positioning information, (f) executing the positioning information, position said type carrier to present the type to be printed into printing position, and (g) energizing said hammer in accordance with the energizing information determined.

2. A method according to claim 1, characterized in that the first algorithm of step (b) is a mod M algorithm, and that the second algorithm of step (c) is a mod N algorithm.

3. A method according to claim 1, characterized in that the first algorithm of step (b) is the quotient formation of the ordinal number and N, the integral quotient representing the typing force index, and that the second algorithm of step (c) is a mod N algorithm.

4. Method according to claims 1 through 3, characterized in that the function f(x) of step (d) is a computable function representing an adequately accurate approximation for the computation of the energizing information.

5. A method according to claim 4, characterized in that the function f(x) is a linear function.

* * * * *

UNITED STATES PATENT AND TRADEMARK OFFICE

CERTIFICATE OF CORRECTION

PATENT NO. : 4,737,044

DATED : April 12, 1988

INVENTOR(S) : PUSCHNUS et al

It is certified that error appears in the above—identified patent and that said Letters Patent is hereby corrected as shown below:

On the title page, Item [73] should read

-- [73] ASSIGNEE: TA TRIUMPH-ADLER AG
Nuernberg, Fed. Rep. of Germany --.

Signed and Sealed this

Eighth Day of November, 1988

*Attest:*

*Attesting Officer*

DONALD J. QUIGG

*Commissioner of Patents and Trademarks*